US006354691B1

(12) United States Patent
Uchikata

(10) Patent No.: US 6,354,691 B1
(45) Date of Patent: Mar. 12, 2002

(54) PRINTING APPARATUS

(75) Inventor: Yoshio Uchikata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/352,950

(22) Filed: Jul. 14, 1999

(30) Foreign Application Priority Data

Jul. 16, 1998 (JP) ..... 10-201790

(51) Int. Cl.[7] ..... B41J 23/00; B41J 21/16
(52) U.S. Cl. ..... 347/37; 400/279
(58) Field of Search ..... 347/5, 9, 10, 37, 347/39; 400/279, 705.1

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,436,439 A | | 3/1984 | Koto | 400/322 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,652,159 A | | 3/1987 | Nagai | 400/322 |
| 4,723,129 A | | 2/1988 | Endo et al. | 347/56 |
| 4,740,796 A | | 4/1988 | Endo et al. | 347/56 |
| 5,310,272 A | * | 5/1994 | Nishizawa | 400/279 |
| 5,427,461 A | * | 6/1995 | Hirai et al. | 400/279 |
| 5,926,192 A | | 7/1999 | Yamane | 347/10 |
| 6,042,281 A | * | 3/2000 | Ohtani | 400/279 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 7-210249 | 8/1995 |
| JP | 9-71008 | 3/1997 |

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A print timing signal is generated which has 1/n the previous cycle of the encoder output. The print processing based on this print timing signal allows the actual print processing to extend into the next encoder cycle when the encoder cycle varies due to carriage speed variations and other causes, and corrects the print start trigger of the next cycle and the print timing cycle on the basis of a time difference by which the actual print processing extends into the next encoder cycle. When performing printing with high resolution in particular, this printing apparatus generates precise print timings, thereby improving the print position accuracy of the print head and performing high quality printing.

9 Claims, 6 Drawing Sheets

PRINTING APPARATUS

This application is based on Japanese Patent Application No. 10-201790 (1998) filed Jul. 16, 1998, the content of which is incorporated hereinto by reference.

BACKGROUND OF THE INVENTION

1. Field of the Invention

The present invention relates to a printing apparatus and more particularly to a print timing control of a print head in the printing apparatus.

2. Description of the Prior Art

A variety of techniques for controlling the print timing have been known and one such example is a technology that generates a print timing by using an encoder. The encoder used by such a printing apparatus is generally known to correspond to the print resolution.

Another conventionally known example uses an encoder with a lower resolution than the print resolution of the printing apparatus, detects leading and trailing edges of two pulse signals AS and BS 90 degrees out of phase with each other and outputs a quadruple-cycle signal to generate a print timing signal with a quadruple resolution.

Still another example uses an encoder with a lower resolution than the print resolution, as in the above example, measures an interval between pulses output from the encoder, and divides the pulse interval one cycle before into n equal parts to generate a print timing signal with a resolution n times the original encoder resolution.

In the case where an encoder matching the print resolution is used, however, printing at high resolution requires an encoder that has a correspondingly high resolution, making the apparatus expensive.

Further, in the case where an encoder with a lower resolution than the print resolution is used and where the leading and trailing edges of two pulse signals AS, BS 90 degrees out of phase are detected to produce a quadruple-cycle signal and thereby generate a print timing signal with a quadruple resolution, when an optical sensor is used in the encoder, interval errors occur which include errors due to sensor characteristic of a light receiving device or the like, phase shifts between A- and B-phase signals, and errors induced by a circuit that transforms an output from the light receiving device into a rectangular pulse signal. The interval errors may cause the print timing to deviate relatively greatly from a desired position. As to a digital servo apparatus, on the other hand, Japanese Patent Laid-Open No. 7-210249 for example discloses a technique that corrects the quadruple interval errors to correct the print position represented by the quadruple signal. In the case of a printing apparatus, however, what is required is not the detection of an accurate print position corresponding to the signal but the generation of a precise print timing for a predetermined print position, and therefore what is disclosed in the official gazette cannot correct the deviation of the print position.

Further, in the case where an encoder with a lower resolution than the print resolution is used and where an interval between adjacent pulse signals is measured and the pulse signal interval one cycle before is divided into n equal parts to generate a print timing signal with a resolution n times the original encoder resolution, a time difference may occur among intervals between two adjacent pulse signals. When such a time difference occurs, a pulse signal interval in the previous cycle may extend and, to that extent, a pulse signal interval in the current cycle shorten, giving rise to a problem that a time required for data transfer and for print processing associated with head driving may become insufficient.

In any of the conventional techniques described above, sudden noise or the like can cause variations in the timing and cycle of the encoder and may result in a failure or error of the print processing.

The present invention has been accomplished to solve the above-described problems and its object is to provide a printing apparatus which, when performing a high resolution printing, can generate a precise print timing to improve the print position accuracy of a print head and thereby perform high quality printing.

Another object of the present invention is to provide a printing apparatus capable of performing printing that prevents errors associated with print positions due to disturbances such as noise from being produced.

SUMMARY OF THE INVENTION

To achieve the above objectives, a printing apparatus using a print head for printing on a print medium according to the invention comprises a head moving means for moving the print head, a head position information detection means for outputting a cyclic signal according to an amount of movement of the print head driven by the head moving means, and a phase interval detection means for measuring a time interval between predetermined reference phases of the cyclic signal output from the head position information detection means. A division means divides the time interval detected by the phase interval detection means into n equal parts and a print timing generation means generates n print timing signals, according to the time interval divided by the division means, by taking as references the predetermined reference phases associated with the time interval measurement by the phase interval detection means. A time difference detection means detects a time difference between a print end time of a previous cycle and the predetermined reference phase of a current cycle on the basis of the cyclic signal outputted from the head position information detection means and the print timing signals generated by the print timing generation means. A correction means corrects the print timing signals of a current cycle generated by the print timing generation means by an amount of the detected time difference when the print end time of the previous cycle lags the predetermined reference phase of the current cycle.

The above printing apparatus using a print head for printing on a print medium preferably has a construction in which when the print end time of the previous cycle lags the predetermined reference phase of the current cycle, the correction means delays a start timing of the current cycle print timing signal generated by the print timing generation means by an amount of the detected time difference and corrects a cycle of the current cycle print timing signal.

A printing apparatus using a print head for printing on a print medium according to the invention comprises a head moving means for moving the print head, a head position information detection means for outputting a cyclic signal according to an amount of movement of the print head driven by the head moving means, and a phase interval detection means for measuring a time interval between predetermined reference phases of the cyclic signal output from the head position information detection means. A division means divides the time interval detected by the phase interval detection means into n equal parts and a print timing generation means generates n print timing signals, according to the time interval divided by the division means, by taking as references the predetermined reference phases associated with the time interval measurement by the phase interval detection means. A correction means corrects a print timing signal of a next cycle generated by the print timing generation means according to a result of comparison between the time interval of a previous cycle and the time interval of a current cycle detected by the phase interval detection means.

The above printing apparatus using a print head for printing on a print medium preferably has a construction in which the correction means corrects a start timing and a cycle of the next cycle print timing signal generated by the print timing generation means according to a result of comparison between the previous cycle time interval and the current cycle time interval detected by the phase interval detection means.

A printing apparatus using a print head for printing on a print medium according to the invention comprises a head moving means for moving the print head, a head position information detection means for outputting a cyclic signal according to an amount of movement of the print head driven by the head moving means, and a phase interval detection means for measuring a time interval between predetermined reference phases of the cyclic signal output from the head position information detection means. A division means divides the time interval detected by the phase interval detection means into n equal parts and a print timing generation mean generates n print timing signals, according to the time interval divided by the division means, by taking as references the predetermined reference phases associated with the time interval measurement by the phase interval detection means. A correction means corrects a print timing signal generated by the print timing generation means according to a difference between the time interval detected by the phase interval detection means and a predetermined time interval when the time interval detected by the phase interval detection means is equal to or less than the predetermined time interval.

Alternatively, a printing apparatus using a print head for printing on a print medium according to the invention comprises a head moving means for moving the print head, a head position information detection means for outputting a cyclic signal according to an amount of movement of the print head driven by the head moving means, and a phase interval detection means for measuring a time interval between predetermined reference phases of the cyclic signal output from the head position information detection means. A division means divides the time interval detected by the phase interval detection means into n equal parts and a print timing generation means generates n print timing signals, according to the time interval divided by the division means, by taking as references the predetermined reference phases associated with the time interval measurement by the phase interval detection means. A correction means corrects a print timing signal generated by the print timing generation means according to a difference between the time interval detected by the phase interval detection means and a predetermined time interval when the time interval detected by the phase interval detection means is equal to or greater than the predetermined time interval.

In measuring the cycle between predetermined reference phases of the output signal of the head position information detection means such as an encoder and dividing the previous cycle into n equal parts to produce the print timing signal, when the end of the actual print processing of the previous cycle extends into the current cycle, the above construction delays the start of the print timing signal of the current cycle to that extent and shortens the current cycle according to the length of time by which the actual print processing of the previous cycle extends into the current cycle.

Because this arrangement uses the same predetermined reference phase at all times, a precise measurement of the cycle can be made even by using an encoder with not so high a precision. Further, the cycle correction can ensure error-free printing and prevent cumulative positional shifts when the end of printing extends into the next cycle.

Further, when the detected cycle is above or below a predetermined value, this is taken as being abnormal. Thus, the print timing can be generated in a cycle that falls within at least a predetermined range.

As a result, it is possible to generate a print timing with virtually high resolution at low cost and perform high quality printing with high resolution. At the same time, the print processing time can be set sufficiently large to enable efficient high-speed printing.

It is also possible to perform stable printing without error even when there are variations in the encoder outputs due to disturbances such as noise.

The above and other objects, effects, features and advantages of the present invention will become more apparent from the following description of embodiments thereof taken in conjunction with the accompanying drawings.

DESCRIPTION OF THE PREFERRED EMBODIMENTS

Embodiments of the present invention will be described by referring to the accompanying drawings.

(First Embodiment)

Figure 1:
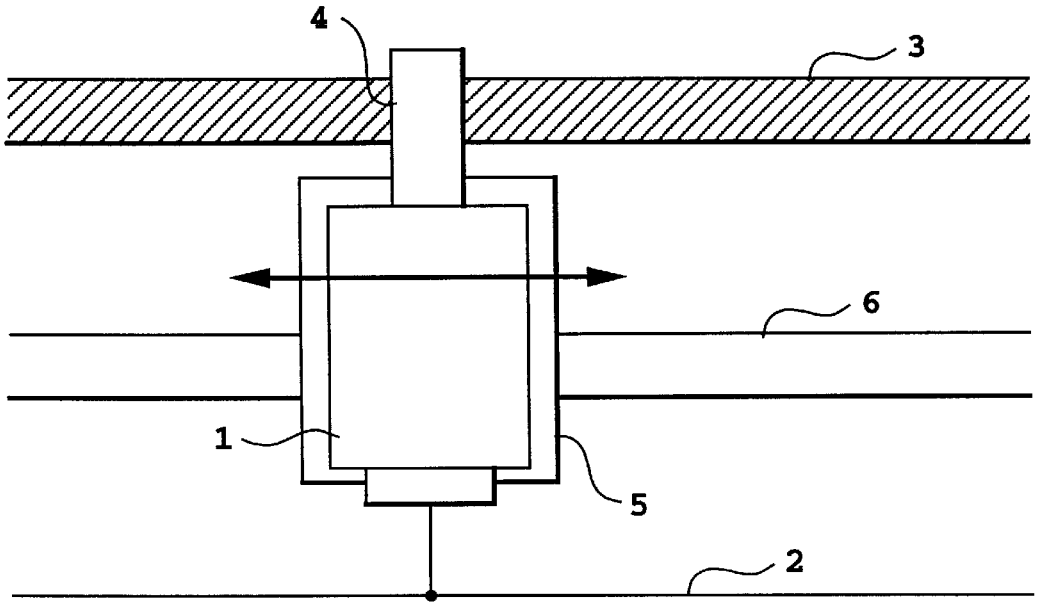
FIG. 1 is a schematic top view showing an outline structure of an ink jet printing apparatus according to one embodiment of the present invention.
Figure 2:
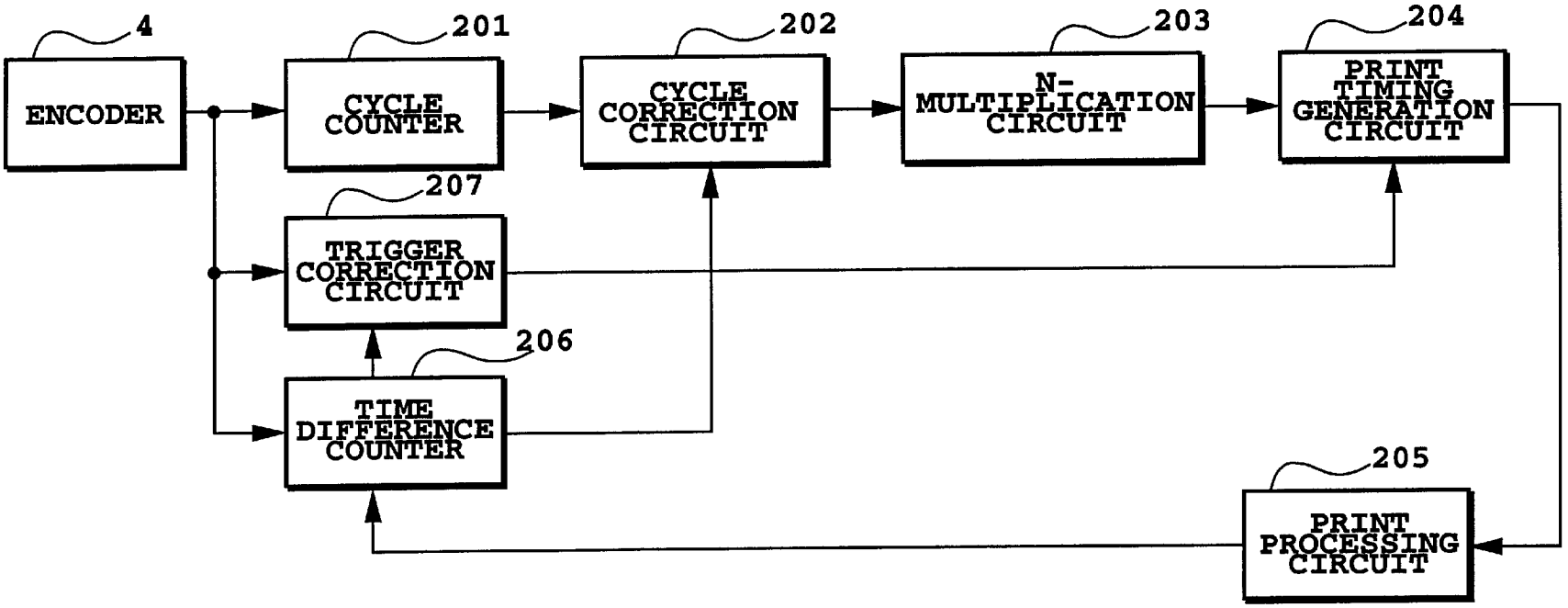
FIG. 2 is a block diagram showing how a print timing is generated according the first embodiment of the invention.
Figure 3:
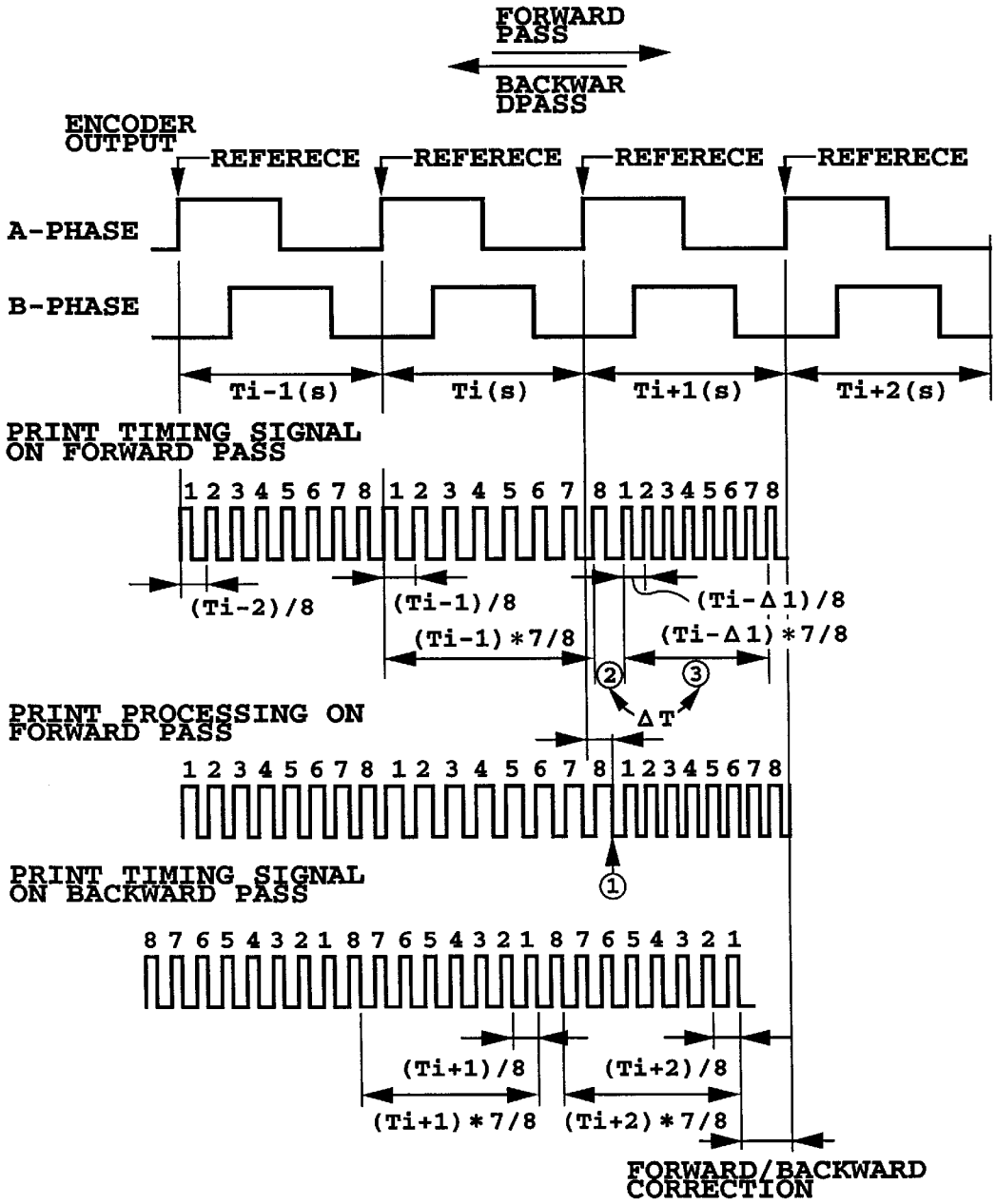
FIG. 3 is a timing chart showing the generation of a print timing signal according to the first embodiment of the invention.

A first embodiment of the inkjet printing apparatus according to the present invention will be described by referring to FIGS. 1, 2 and 3. FIG. 1 is a top view showing the outline construction of the ink jet printing apparatus, FIG. 2 is a circuit block diagram showing the generation of a print timing based on the output of the encoder, and FIG. 3 is a timing chart showing the generation of a print timing signal based on a phase output from the encoder.

In FIG. 1, reference number 1 represents an ink jet unit that comprises a print head and an ink cartridge. Among various types of ink jet system, this system employs the print head that utilizes thermal energy to form a bubble to eject an ink droplet. The print head and the cartridge are both removably mounted on a carriage 5. The carriage 5 slidably engages a guide shaft 6 and can be driven by a drive mechanism not shown along the guide shaft 6 in the direction of an arrow in the figure. Thus, the print head can scan over a print medium 2 such as paper and, during the scan, ejects ink onto the print medium 2 to perform printing. Denoted 3 is a linear scale provided with slits at constant intervals and which extends in the direction of movement of the carriage 5. Mounted on the carriage 5 is an encoder 4 having a pair of light emitting portion and a light receiving portion. As the carriage 5 moves, the encoder 4 outputs a signal according to the position of a slit on the linear scale 3.

The linear encoder comprising the linear scale 3 and the optical encoder 4 is known, and the optical encoder 4 has two stationary slits disposed at an angle of 90 degrees to each other and facing the slits of the linear scale 3 to generate encoder outputs of A- and B-phase signals 90 degrees out of phase with each other. Each of the two stationary slits is provided with a light receiving portion, and these two light receiving portions receive light from the light emitting portion that has passed through the slit of the linear scale 3. With this construction, the linear encoder can detect the position of the moving print head 1 and output a signal as a position information of the print head. A print head drive control drives the print head according to the position information of the print head to eject ink at a specified position as the print head scans over the print medium 2.

The linear scale 3 is formed with slits that correspond to a relatively low resolving power which is 1/n the print resolution. As the demand for a higher printed image quality increases, there is a growing demand on the linear encoder itself for a higher resolution. Forming the slits and optical encoder with a high resolving power may increase cost as well as noise and error components, as described earlier, which in turn requires a filter circuit for eliminating the noise and error components and thus results in a cost increase. In this embodiment, however, the slits of the linear scale 3 are formed at a relatively low resolving power which is 1/n the print resolution, thus allowing the linear encoder to be constructed inexpensively.

FIG. 3 shows the A-phase and B-phase outputs of the light receiving portions of the optical encoder 4. The power of received light of the light receiving portions becomes maximum when a window of the slit of the linear scale 3 coincides with a window of the stationary slit of the optical encoder 4 and minimum when these windows are shifted 180 degrees out of phase. The power of the received light changes almost linearly between the maximum and the minimum. As a result, the continuous waveforms of power of the received light as the carriage 5 moves are actually triangular waveforms. The output signals of phase A and phase B as shown in FIG. 3 are obtained by converting the triangular waves into pulse signals with a predetermined average level taken as a reference. These pulse signals are 90 degrees out of phase as shown in the figure.

The leading and trailing edges of the A- and B-phase signals are detected to generate a timing signal, whose cycle is four times that of the original signal, i.e., four times the original resolving power. As described above, however, this also increases errors that are associated with characteristics of the light receiving sensor of the optical encoder 4, phase shifts of the A- and B-phase signals, and a signal processing circuit that converts an analog signal output from the light receiving portion into a rectangular waveform signal. Therefore, using the quadruple-cycle signal as is to generate a print timing signal cannot produce an accurate print timing. Further, even if an arrangement for correction is made to produce an accurate print position corresponding to the quadruple-cycle signal as disclosed in the above-described official gazette, because the correction provided by this method does not eliminate effects of the above-described errors, the corrected print position represented by the quadruple-cycle signal deviates from the intended print position when the errors occur. Thus, the signal produced by this method also cannot be used as the print timing representing the precise print position.

This embodiment thus generates a print timing by a circuit configuration shown in FIG. 2. In FIG. 2, a cycle counter 201 measures a previous cycle between reference phases of an output signal of the encoder 4 and outputs the measured cycle to a cycle correction circuit 202. An n-multiplication circuit 203 multiplies the corrected cycle output from the cycle correction circuit 202 by 1/n and sends a multiplied result to a print timing generation circuit 204. A print processing circuit 205 drives the print head 1 according to a print timing signal from the print timing generation circuit 204 to perform printing. When the printing for n cycles has finished, the print processing circuit 205 outputs a print end signal to a time difference counter 206. The time difference counter 206 measures a time difference between a reference phase of the encoder 4 for the current printing and the print end signal.

When, according to the measured result produced by the time difference counter 206, the print end signal is found lagging the reference phase of the encoder 4 for the current printing, a trigger correction circuit 207 makes correction to delay the start of the print timing signal (trigger) by the time difference. When the print end signal is found leading the reference phase of the encoder 4 for the current printing, the trigger correction circuit 207 does not perform correction. Similarly, when the print end signal is found lagging the current printing reference phase of the encoder 4 according to the measured result produced by the time difference counter 206, the print processing circuit 205 makes correction to shorten the cycle by the time difference. When the print end signal occurs before the current printing reference phase of the encoder 4, the print processing circuit 205 does not perform correction. The print timing generation circuit 204 generates the print timing signal for n cycles according to the cycle output from the n-multiplication circuit 203 and the trigger output from the trigger correction circuit 207.

Although we have shown an example case that uses the trigger correction circuit 207 and the cycle correction circuit 202 to correct the print trigger and the print cycle, it is possible to produce the print trigger at a point in time when the print end signal is generated or at a point in time when the encoder's reference phase rises, whichever is later. If the next reference signal occurs before the printing ends, the cycle counter may be decremented until the print ends.

FIG. 3 is a waveform diagram showing example signals generated by the circuit blocks shown in FIG. 2.

This example represents a case where printing is performed at a cycle, equal to ⅛ the encoder cycle, which is produced by an 8-multiplication circuit. The reference phase of the encoder output for generating the print timing is a rising edge of the A-phase signal at any print cycle. Because the encoder output B-phase signal or the trailing edge is not used and the same phase is used as a reference at all times, a precise timing can be generated even when inexpensive linear scale and encoder are used.

Then, if the print end signal associated with the print timing signal generated by the previous encoder cycle ((1) in the figure) lags the reference phase for the current printing, a correction is made to delay the start of the current printing trigger signal by the time difference ΔT ((2) in the figure), thus allowing the printing to continue without error.

Further, because the length of the print cycle is shortened by the time difference ΔT ((3) in the figure), it is possible to eliminate the problem that the time difference accumulates shifting the print positions successively as would occur when the print timing is simply delayed by the time difference. This assures printing with fewer errors.

Further, if the actual print processing associated with the previous print cycle moves into the next print cycle, the time length by which the print processing gets into the next print cycle is taken as the time difference ΔT and the corresponding correction as described above is performed. This correction prevents the time difference from getting accumulated and shifting the print position greatly. When viewed in another way, this allows the print processing to get into the next print processing, making it possible to set the print processing time at a sufficiently large value regardless of cycle variations, which in turn assures stable and high-speed printing.

As shown in FIG. 3, the similar control is made of the print timing on the backward or return printing pass.

On the backward printing pass, the trailing edge of the A-phase signal is used as a reference phase. This allows the print timing to be generated at the same phase with respect to the linear scale position as the forward printing pass.

In an ink jet printing system like this embodiment, there is a certain space between the print head and the print medium. Hence, the time it takes for an ink droplet to fly and reach the print medium may change depending on whether the printing is on the forward pass or on the backward pass, which may in turn cause deviations in ink droplet landing positions. Hence, a forward/backward pass timing correction is performed to correct the landing deviations.

(Second Embodiment)

Figure 4:
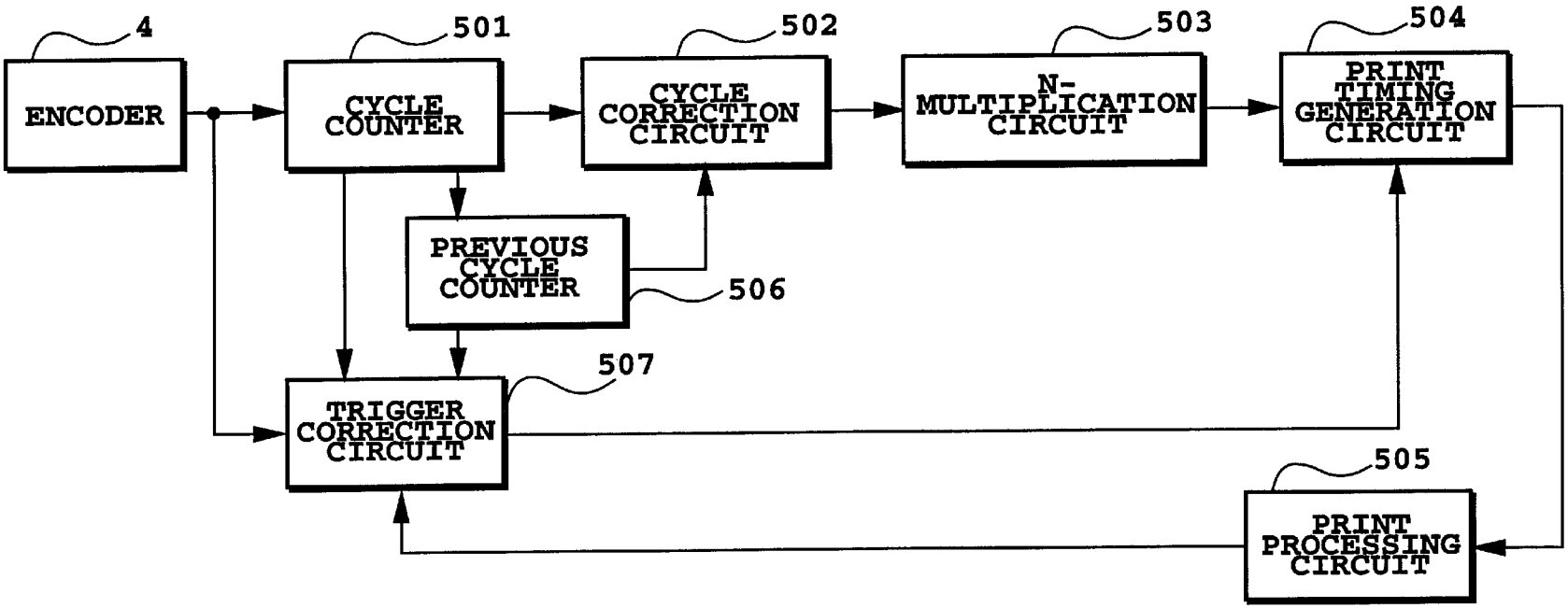
FIG. 4 is a circuit block diagram showing how a print timing is generated according to a second embodiment of the invention.
Figure 5:
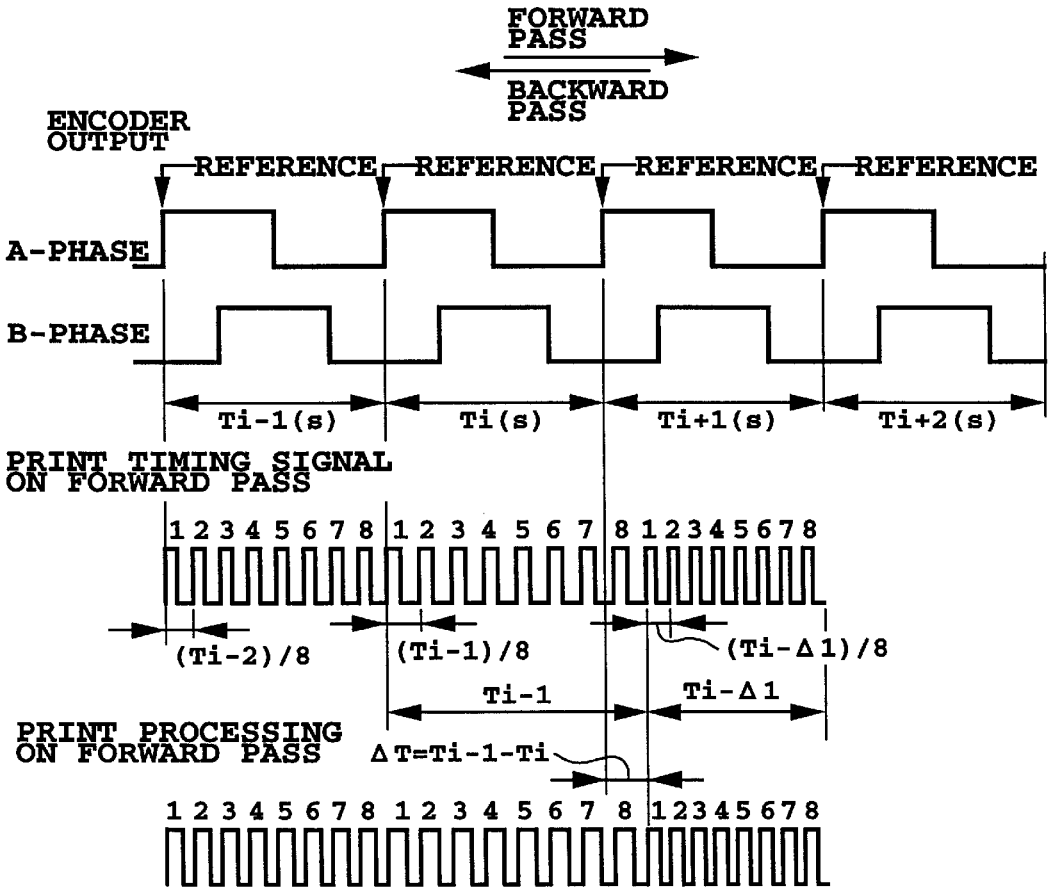
FIG. 5 is a timing chart showing the generation of a print timing signal according to the second embodiment of the invention.

Next, a second embodiment of the ink jet printing apparatus according to the present invention will be described by referring to FIGS. 4 and 5. FIG. 4 is a circuit block diagram showing how a print timing is generated based on the output of an encoder. FIG. 5 is a timing chart showing a print timing signal.

In FIG. 4, a cycle counter 501 measures a cycle between reference phases of the output signal of the encoder 4 and outputs the measured cycle to a cycle correction circuit 502. An n-multiplication circuit 503 multiplies the cycle output from the cycle correction circuit 502 by 1/n and outputs the result to a print timing generation circuit 504. A print processing circuit 505 drives the print head 1 according to the print timing signal from the print timing generation circuit 504 to perform printing.

A previous cycle counter 506 stores a previous cycle time of a reference signal A. When the value of the previous cycle counter 506 is larger than the value of the current cycle time measured by the cycle counter 501, a trigger correction circuit 507 corrects a print trigger of the next cycle by the time difference between the two count values. When the value of the cycle counter 501 is larger than the value of the previous cycle counter 506, no correction is made. In this case, the reference phase of the output of the encoder 4 is used as the trigger. When the value of the previous cycle counter 506 is larger than the value measured by the cycle counter 501, the cycle correction circuit 502 subtracts the time difference between the two count values from the value of the cycle counter 501 and outputs the next cycle time. When the value of the cycle counter 501 is larger than the value of the previous cycle counter 506, no correction is made and the value of the cycle counter 501 is output as is.

The print timing generation circuit 504 generates a print timing signal for n cycles according to the cycle output from the n-multiplication circuit 503 and the trigger output from the trigger correction circuit 507.

FIG. 5 is a waveform diagram showing signals generated by the circuit blocks shown in FIG. 4. What is shown here represents a case where printing is performed at a cycle, equal to ⅛ the encoder cycle, which is produced by an 8-multiplication circuit 503.

As shown in FIG. 5, the reference phase of the encoder output for generating the print timing is a rising edge of the A-phase signal at any print cycle. Because the encoder output B-phase signal or the trailing edge is not used and the same phase is used as a reference at all times, a precise timing can be generated even when inexpensive linear scale and encoder are used.

Then, if the print processing associated with the print timing signal generated by the previous encoder cycle extends beyond the print start timing of the current encoder cycle, the print trigger of the next cycle is corrected by this excess time ΔT, thus allowing the printing to continue without error.

Further, because the print cycle is corrected, it is possible to eliminate the problem that the time difference accumulates shifting the print positions successively as would occur when the print timing is simply delayed by the time difference. This ensures printing with fewer errors.

When viewed in another way, the above configuration allows the excess time to be present, making it possible to set the print processing time at a sufficiently large value regardless of cycle variations, which in turn assures stable and high-speed printing.

(Third Embodiment)

Figure 6:
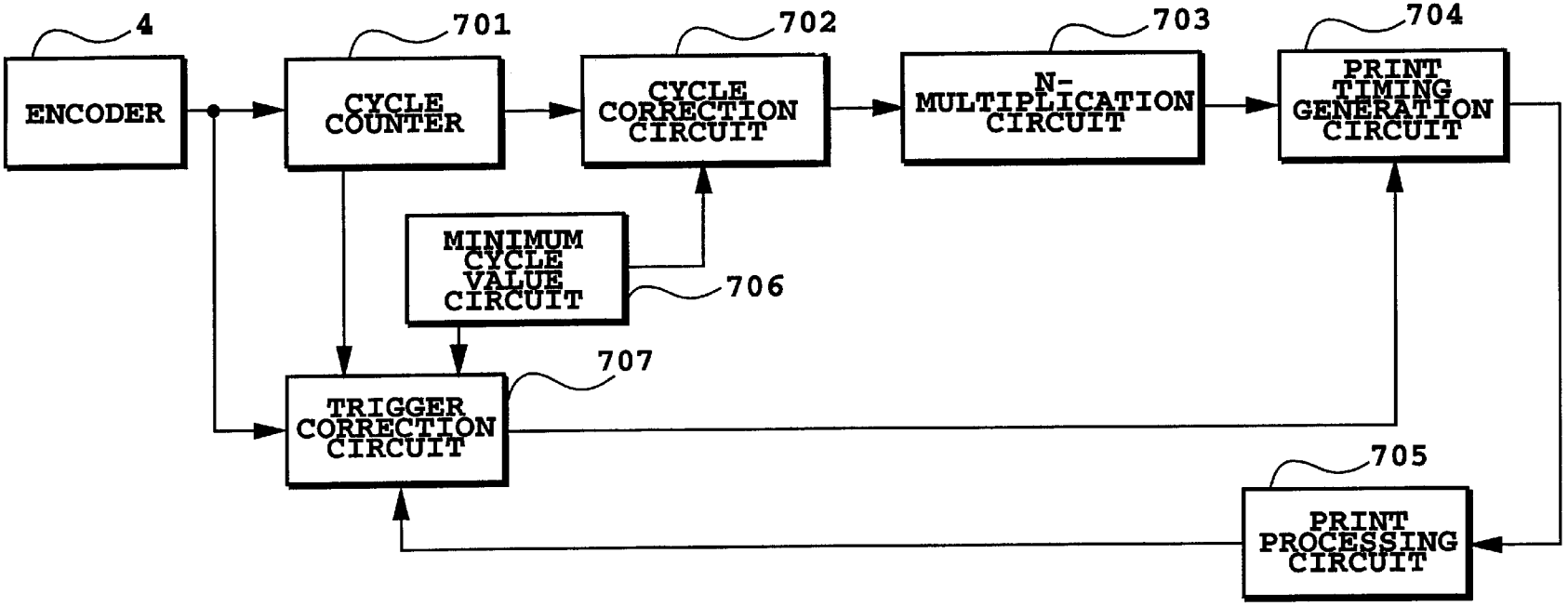
FIG. 6 is a circuit block diagram showing how a print timing is generated according to a third embodiment of the invention.

A third embodiment of the ink jet printing apparatus according to the present invention will be described by referring to FIG. 6. FIG. 6 is a circuit block diagram showing how a print timing is generated based on the encoder output.

In FIG. 6, a cycle counter 701 measures a cycle between reference phases of the output signal of the encoder 4 and outputs the measured cycle to a cycle correction circuit 702. An n-multiplication circuit 703 multiplies the cycle output from the cycle correction circuit 702 by 1/n and outputs the result to a print timing generation circuit 704. A print processing circuit 705 drives the print head 1 according to the print timing signal from the print timing generation circuit 704 to perform printing.

A minimum cycle value circuit 706 in the apparatus of this embodiment stores in advance a minimum required time for executing print processing, such as data transfer and print head driving. When the value of the cycle counter 701 is smaller than the value of the minimum cycle value circuit 706, a trigger correction circuit 707 corrects a trigger by the time difference between the two values. When the value of the cycle counter 701 is larger than the value of the minimum cycle value circuit 706, the trigger correction circuit 707 does not perform the correction and the reference phase of the output of the encoder 4 is used as the trigger. Similarly, when the value of the cycle counter 701 is smaller than the value of the minimum cycle value circuit 706, the cycle correction circuit 702 outputs a cycle obtained by adding the time difference between the two values to the value of the cycle counter 701. When the value of the cycle counter 701 is larger than the value of the minimum cycle value circuit 706, the cycle correction circuit 702 does not perform correction and outputs the value of the cycle counter 701 as is. The print timing generation circuit 704 generates a print timing signal for n cycles according to the cycle output from the n-multiplication circuit 703 and the trigger output from the trigger correction circuit 707.

With the above configuration it is possible to continue printing without error even when disturbances such as sudden noise cause the encoder cycle to vary and fall below the minimum cycle value.

Further, when the value of the cycle counter 701 is smaller than the predetermined value, or when an occasion where the value is smaller than the predetermined value occurs successively, this is decided as abnormal and an error indication is produced. This makes it possible to detect anomalies other than sudden disturbances and cope with them.

Although in the above description only a decision is made of the minimum cycle value, it is also possible to check the maximum value of the cycle in the similar manner, so that even when the encoder cycle changes suddenly due to disturbances such as noise, the printing can be continued without error. In this case, too, when the cycle counter value is larger than the predetermined value, or when an occasion where the value is greater than the predetermined value occurs successively, this is decided as abnormal and an error indication is produced. This makes it possible to detect anomalies other than sudden disturbances and cope with them.

(Other Embodiments)

While the foregoing embodiments have described example cases of ink jet printing apparatus, the present invention can also be applied to other printing apparatus, such as those of thermal type and thermal ink transfer type.

Further, although the above embodiments concern an example case using an optical linear encoder, the present invention can also be applied to other types of detection systems, such as those of rotary type and magnetic type.

(Others)

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied to either on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of the temperature 30°–70° so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces to the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus using a print head for printing on a print medium, comprising:

a head moving means for moving the print head;

a head position information detection means for outputting a cyclic signal according to an amount of movement of the print head driven by the head moving means;

a phase interval detection means for measuring a time interval between predetermined reference phases of the cyclic signal output from the head position information detection means;

a division means for dividing each time interval detected by the phase interval detection means into n equal parts;

a print timing generation means for generating n print timing signals, according to the time interval divided by the division means, by taking as references the predetermined reference phases associated with the time interval measurement made by the phase interval detection means;

a time difference detection means for detecting a time difference between a print end time of a previous cycle and the predetermined reference phase of a current cycle on the basis of the cyclic signal outputted from the head position information detection means and the print timing signals generated by the print timing generation means; and a correction means for correcting timing of the n print timing signals of a current cycle generated by the print timing generation means by an amount of the detected time difference when the print end time of the previous cycle lags the predetermined reference phase of the current cycle.

2. A printing apparatus as claimed in claim 1, wherein when the print end time of the previous cycle lags the predetermined reference phase of the current cycle, the correction means delays a start timing of the current cycle print timing signal generated by the print timing generation means by an amount of the detected time difference and corrects a cycle of the current cycle print timing signal.

3. A printing apparatus as claimed in claim 1, wherein the n associated with the print timing generation by the print timing generation means is two or more.

4. A printing apparatus as claimed in claim 1, wherein the print head performs printing by ejecting ink.

5. A printing apparatus as claimed in claim 4, wherein the print head utilizes thermal energy to generate a bubble in ink and eject the ink by a pressure of the bubble.

6. A printing apparatus using a print head for printing on a print medium, comprising:

a head moving means for moving the print head;

a head position information detection means for outputting a cyclic signal according to an amount of movement of the print head driven by the head moving means;

a phase interval detection means for measuring a time interval between predetermined reference phases of the cyclic signal output from the head position information detection means;

a division means for dividing each time interval detected by the phase interval detection means into n equal parts;

a print timing generation means for generating n print timing signals, according to the time interval divided by the division means, by taking as references the predetermined reference phases associated with the time interval measurement made by the phase interval detection means; and a correction means for correcting timing of n print timing signals of a next cycle generated by the print timing generation means by a time difference detected as a result of a comparison between the time interval of a previous cycle and the time interval of a current cycle detected by the phase interval detection means.

7. A printing apparatus as claimed in claim 6, wherein the correction means corrects a start timing and a cycle of the next cycle print timing signal generated by the print timing generation means according to a result of comparison between the previous cycle time interval and the current cycle time interval detected by the phase interval detection means.

8. A printing apparatus using a print head for printing on a print medium, comprising:

a head moving means for moving the print head;

a head position information detection means for outputting a cyclic signal according to an amount of movement of the print head driven by the head moving means;

a phase interval detection means for measuring a time interval between predetermined reference phases of the cyclic signal output from the head position information detection means;

a division means for dividing each time interval detected by the phase interval detection means into n equal parts;

a print timing generation means for generating n print timing signals, according to the time interval divided by the division means, by taking as references the predetermined reference phases associated with the time interval measurement made by the phase interval detection means; and a correction means for correcting timing of the n print timing signals generated by the print timing generation means by a time difference between the time interval detected by the phase interval detection means and a predetermined time interval when the time interval detected by the phase interval detection means is equal to or less than the predetermined time interval.

9. A printing apparatus using a print head for printing on a print medium, comprising:

a head moving means for moving the print head;

a head position information detection means for outputting a cyclic signal according to an amount of movement of the print head driven by the head moving means;

a phase interval detection means for measuring a time interval between predetermined reference phases of the cyclic signal output from the head position information detection means;

a division means for dividing each time interval detected by the phase interval detection means into n equal parts;

a print timing generation means for generating n print timing signals, according to the time interval divided by the division means, by taking as references the predetermined reference phases associated with the time interval measurement made by the phase interval detection means; and a correction means for correcting timing of the n print timing signals generated by the print timing generation means by a time difference between the time interval detected by the phase interval detection means and a predetermined time interval when the time interval detected by the phase interval detection means is equal to or greater than the predetermined time interval.

* * * * *